United States Patent [19]

Williams

[11] Patent Number: 4,530,692

[45] Date of Patent: Jul. 23, 1985

[54] APPARATUS FOR OPENING FOLDED CORRUGATED CARTONS

[75] Inventor: Donald H. Williams, Adams, Wis.

[73] Assignee: Consolidated Papers, Inc., Wisconsin Rapids, Wis.

[21] Appl. No.: 526,264

[22] Filed: Aug. 25, 1983

[51] Int. Cl.[3] ..... B31B 1/78; B31B 1/52

[52] U.S. Cl. ..... 493/309; 493/457

[58] Field of Search ..... 493/309, 316, 457, 310

[56] References Cited

U.S. PATENT DOCUMENTS

| | | | |
|---|---|---|---|
| 709,501 | 9/1902 | Munson | 493/309 |
| 1,058,858 | 4/1913 | Graffenberger | 493/309 |
| 1,831,837 | 11/1931 | Baldenhofer | 493/309 |
| 2,581,491 | 1/1952 | Linstedt | 493/309 |
| 3,418,894 | 12/1968 | Jivoin | 493/309 |

*Primary Examiner*—Lowell A. Larson
*Assistant Examiner*—William E. Terrell
*Attorney, Agent, or Firm*—Gary, Juettner & Pyle

[57] ABSTRACT

Apparatus for opening a folded rectangular corrugated carton, of a type having score lines between panels thereof, is characterized by a pair of V-shaped channels for receiving the folded carton therebetween, such that score lines along opposite side edges of the carton are positioned within the channels. A motor drives the channels together, so that as pressure is applied to the carton the panels are folded about the panel scores to open the carton.

3 Claims, 3 Drawing Figures

2.
38
40
46
44
42
50
48
64
22
34
32
36
68
30
66
62
54
52
60
28
20
26

40
22
68
64
58a
32
30
56b
56a
66
24
60
62
58c
58b
56c
56d
58d
20
28
26

40
22
64
36
24
60
68
66
32
30
56a
56b
58c
62
58b
56c
56d
20
28
26

APPARATUS FOR OPENING FOLDED CORRUGATED CARTONS

BACKGROUND OF THE INVENTION

The present invention relates to an apparatus for opening folded corrugated cartons which are otherwise difficult to open by hand.

Cardboard or corrugated boxes or cartons are used to package various goods. Conventionally, such a carton comprises a rectangular cardboard sleeve which has corners defined by score lines between panels and is slit along its corners at its ends to define end flaps. To form the carton bottom wall, one pair of opposed flaps at one end of the sleeve are folded inwardly, the other pair of flaps are then folded inwardly across the one pair, and the flaps are secured in position by adhesive, tape or any other suitable means. Goods may then be placed in the carton through the opposite open end, whereafter the end is closed by folding and sealing the flaps thereat.

As manufactured, corrugated cartons are usually folded flat along opposite score lines or corners and placed one on top of another in a stack to minimize storage requirements. At the time of use, the panels of a flat carton are pivoted along the score lines to define the corners and side walls of the carton, one end of the carton is closed and the carton is then filled through the other end. Large cartons may be relatively easily manually opened from a flat, folded condition for filling and shipment. However, a corrugated carton made of different grades and flutes, and which has small panels, can be difficult to open by hand.

OBJECT OF THE INVENTION

The primary object of the present invention is to provide an apparatus for mechanically opening corrugated cartons from a flat, folded condition, and which is particularly useful in opening cartons having relatively small panels.

SUMMARY OF THE INVENTION

In accordance with the present invention, apparatus for opening a corrugated carton comprises a pair of V-shaped channels extending generally parallel to one another with their open ends in facing relationship, and means for moving the channels toward and away from each other between a first position whereat the channels are remotely spaced and a second position whereat they are more closely spaced. A folded rectangular corrugated carton having a first pair of score lines along its opposite edges and a second pair of score lines intermediate the edges, which score lines connect panels of the carton, is positionable between the channels when the same are in the first position, such that the opposite edges of the carton are received within the open ends of the channels. Upon movement of the channels together to the second position, the channels exert pressure on the opposite carton edges, and as the pressure is applied it forces the panels to pivot about the first and second pairs of score lines to open the carton. Advantageously, means is also provided for controlling the spacings between the channels when they are in the first and in the second positions to accommodate cartons of different sizes.

The foregoing and other objects, advantages and features of the invention will become apparent upon a consideration of the following detailed description, when taken in conjunction with the accompanying drawings.

DETAILED DESCRIPTION

Figure 1:
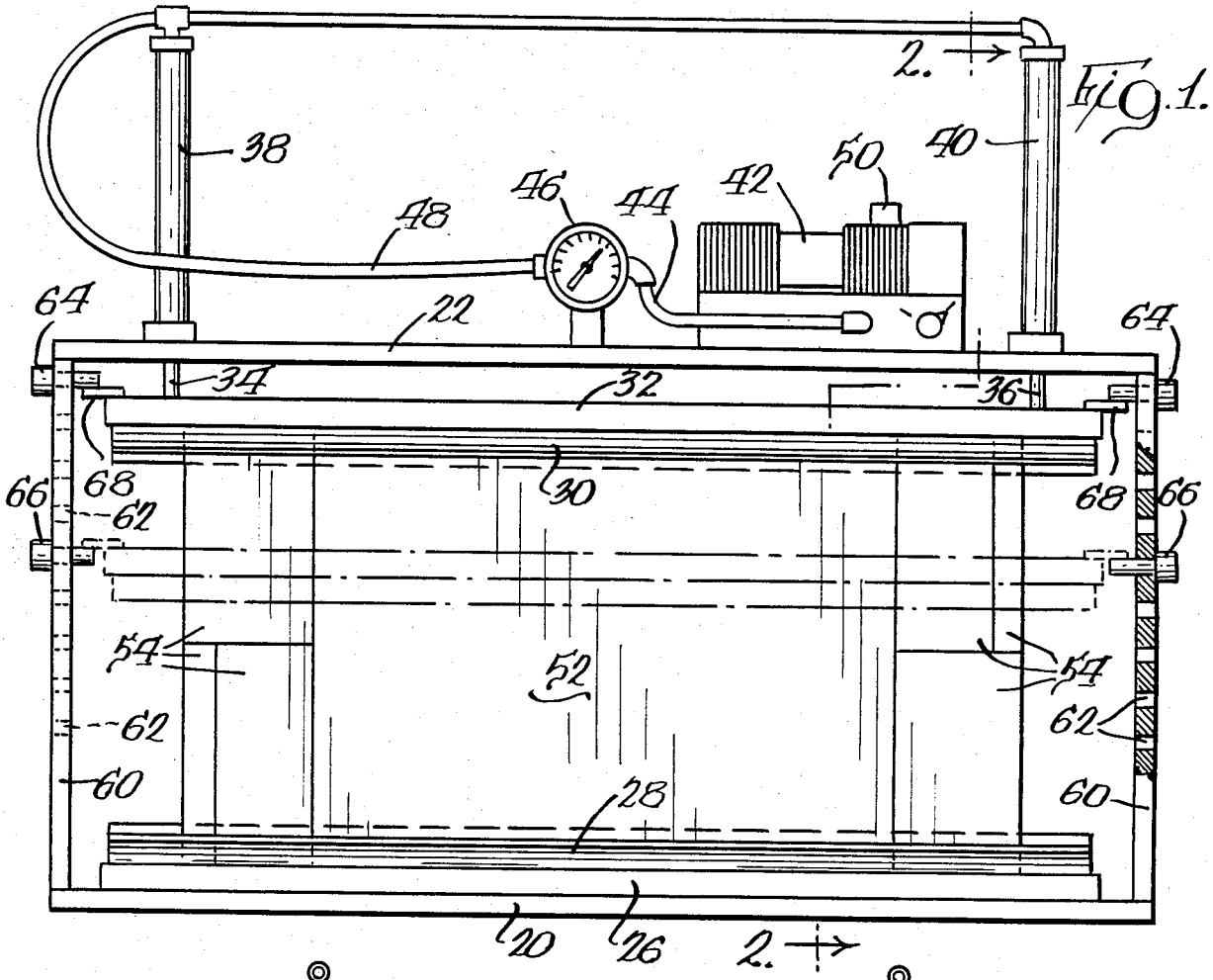
FIG. 1 is a side elevation view, partly in cross section, illustrating an apparatus for opening a corrugated carton.

Referring to the drawings, an apparatus for opening a folded corrugated rectangular carton or box comprises a generally rectangular framework having a base 20, a top 22 and supports 24 at each corner for carrying the top above the base. An elongate brace bar 26 is on the base, and has a groove in its upper surface in which is carried a V-shaped channel 28, such that an apex of the channel is within the groove and an open side of the channel extends upwardly. Vertically above the channel 28 is a second V-shaped channel 30 carried in an elongate brace bar 32, such that an apex of the channel 30 is within a groove in the lower surface of the bar and an open side of the channel extends downwardly in facing relationship to the channel 28.

The channel 30 is mounted for vertical movement toward and away from the channel 28, and to that end opposite ends of the brace bar 32 are connected to downwardly extending piston rods 34 and 36 of respective air cylinders 38 and 40 supported on the top 22. Air under pressure from a source thereof (not shown) is applied through a controller 42, a line 44, a pressure regulator and gauge 46 and a line 48 to the cylinders under control of a manually operable start and reverse switch 50 on the controller. For the arrangement shown, the air cylinders may be provided with internal springs which urge pistons thereof in the upward direction to normally maintain the channel 30 in an elevated position, and the switch 50 is operable to alternately apply compressed air to the cylinders to drive the piston rods downwardly against the springs and to interrupt supply of compressed air so that the springs move the piston rods upwardly. It is understood, however, that the air cylinders could have air inlets to opposite sides of their pistons, in which case the switch 50 would then be operable to alternately apply compressed air to the inlets on one side of the pistons and then to the inlets on the other side.

Figure 2:
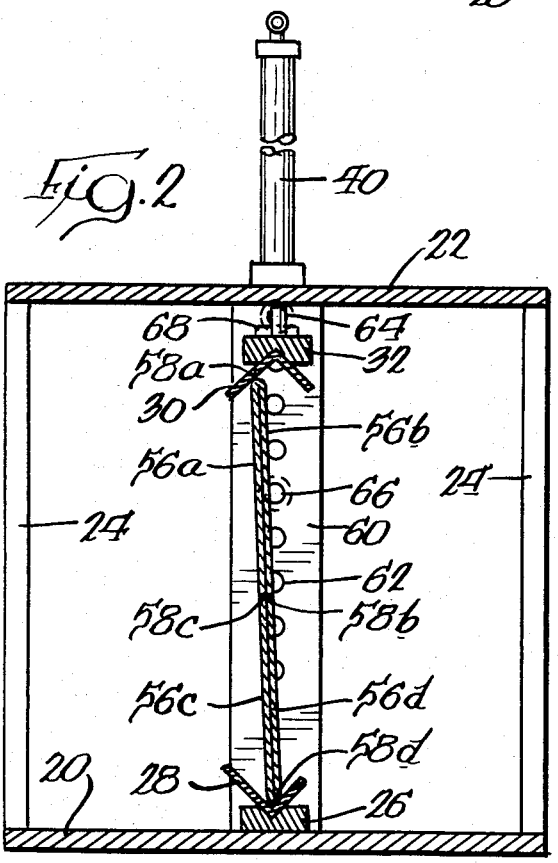
FIG. 2 is a cross sectional side elevation view taken substantially along the lines 2—2 of FIG. 1, illustrating the apparatus in position for receiving a folded corrugated carton.

The device is adapted to open a rectangular corrugated carton, which as manufactured is folded flat, for example a carton 52 having four flaps 54 at each of its ends and four sides or panels **56*a–d* pivotably interconnected by score lines 58*a–d* which define corners between the panels when the carton is open. As folded, the score lines 58*a* and 58*d* lie along opposite side edges of the carton, and the carton is placed between and within the open sides of the channels 28 and 30, such that the edge of the carton including the score line 58*d* is within the channel 28 and the edge including the score line 58*a* is within the channel 30. At this time, as shown in FIG. 2 the carton is flat and the piston rods 34 and 36 are retracted, so that the channel 30** is in a first or uppermost position. To facilitate inserting the folded carton into and between the channels, it is contemplated that the forward facing legs of the channels, for example the rightward legs as seen in FIG. 2, be shorter than the rearward legs.

Figure 3:
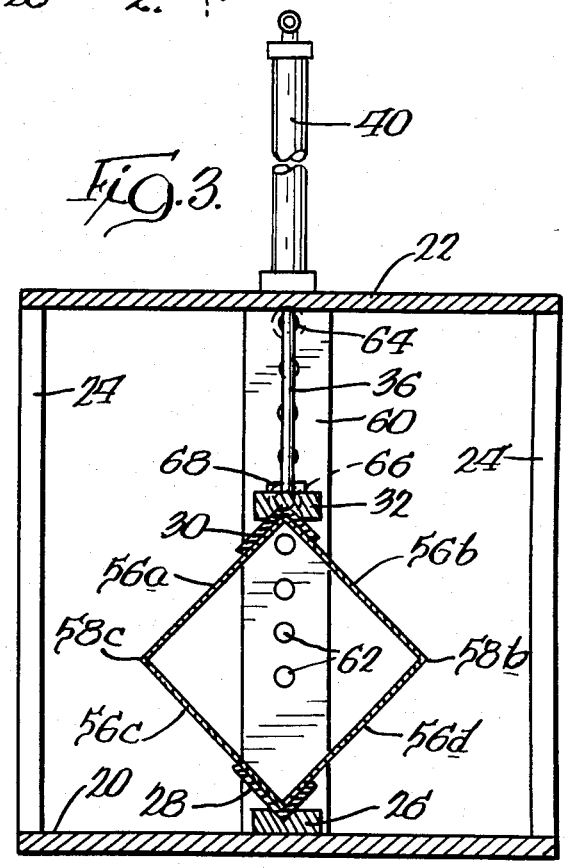
FIG. 3 is similar to FIG. 2, except that the apparatus is shown in the position in which it has mechanically opened the carton.

With the carton 52 between the channels 28 and 30, it may be opened simply by actuating the switch 50 to operate the air cylinders 38 and 40 to drive the channel 30 toward the channel 28. This captures the carton between the channels and applies pressure to the carton, which as shown in FIG. 3 forces the medially located panel scores **58*b* and 58*c* to move outwardly away from each other, the panel scores 58*a* and 58*d* to move inwardly toward each other, and the panels 56*a–d* to pivot about the panel scores until the channel 30 is in a second or lowermost position and the carton has been opened to a substantially rectangular configuration. When the carton is open, the switch is again actuated to retract the piston rods and elevate the channel 30** to the first position, whereupon the carton may be removed and filled for shipment.

To accommodate cartons of different sizes, the maximum and minimum vertical height of the channel 30 above the channel 28 may be adjustably controlled. Accordingly, adjustment bars 60 are at opposite sides of the rectangular frame, and extend vertically along the direction of travel of the ends of the channel 30. A plurality of vertically spaced passages 62 are formed through each adjustment bar, and a pair of adjustment pins 64 and 66 are extendable through selected pairs of passages in each bar. Stops 68 extend outwardly from each end of the brace bar 32, and inner ends of the pins 64 and 66 extend inwardly beyond the outer ends of the stops. Accordingly, with the stops between the pins 64 and 66, the maximum vertical height of the channel 30 may be adjusted by positioning the pins 64 through selected passages in the adjustment bars, and the minimum vertical height by extending the pins 66 through selected lower passages in the bars. As the channel 30 moves upwardly the stops engage the pins 64, whereupon further upward movement under the urging of the springs is prevented, and as the channel moves downwardly the stops engage the pins 66, which resist further downward movement of the channel under the urging of compressed air. Consequently, the range of vertical movement of the channel may be controlled to accommodate cartons of various sizes.

While one embodiment of the invention has been described in detail, various modifications and other embodiments thereof may be devised by one skilled in the art without departing from the spirit and scope of the invention, as defined in the appended claims.

What is claimed is:

1. A device for opening a rectangular corrugated carton of a type which has score lines defining corners between side panels thereof and which is initially folded flat into generally rectangular form such that a first pair of score lines extend along opposite side edges of the flat carton and a second pair of score lines extend along opposite sides of the folded carton parallel to and intermediate the first pair, comprising first and second engaging means; means mounting said first and second engaging means in spaced relationship and for movement toward and away from each other; and means coupled with said first and second engaging means for moving said first and second engaging means relative to and toward and away from each other, said first and second engaging means receiving opposite side edges of the folded carton when the same are moved away from each other and engaging and pressing against the carton side edges when the same are moved toward each other to move the first pair of score lines together and the second pair of score lines apart and to pivot the panels about the score lines to open the carton, wherein said moving means comprises motor means for moving said first and second engaging means toward and away from each other, said device including adjustment means for controlling said first and second engaging means to control the maximum and minimum spacings between said engaging means to accommodate opening folded cartons of various different sizes, said adjustment means including stop means for limiting movement of said first and second engaging means to be between said maximum and minimum spacings, and wherein said second engaging means is fixedly mounted and said first engaging means is moved by said motor means, and said stop means limits movement of said first engaging means to be between selected first and second positions with respect to said second engaging means.

2. A device for opening a rectangular corrugated carton of a type which has score lines defining corners between side panels thereof and which is initially folded flat into generally rectangular form such that a first pair of score lines extend along opposite side edges of the flat carton and a second pair of score lines extend along opposite sides of the folded carton parallel to and intermediate the first pair, comprising first and second engaging means; means mounting said first and second engaging means in spaced relationship and for movement toward and away from each other; and means coupled with said first and second engaging means for moving said first and second engaging means relative to and toward and away from each other, said first and second engaging means receiving opposite side edges of the folded carton when the same are moved away from each other and engaging and pressing against the carton side edges when the same are moved toward each other to move the first pair of score lines together and the second pair of score lines apart and to pivot the panels about the score lines to open the carton, wherein said moving means comprises motor means for moving said first and second engaging means toward and away from each other, said device including adjustment means for controlling said first and second engaging means to control the maximum and minimum spacings between said engaging means to accommodate opening folded cartons of various different sizes, wherein said second engaging means is fixedly mounted and said first engaging means is moved by said motor means, and said stop means limits movement of said first engaging means to be between selected first and second positions with respect to said second engaging means, and wherein said stop means includes a first plate coupled with and fixedly mounted by said means for mounting and having spaced passages therethrough extending along the direction of travel of said first engaging means and a first pair of pins extendable through a selected pair of said passages for engaging said first engaging means and limiting movement thereof to between said first and second positions.

3. A device as in claim 2, wherein said stop means also includes a second plate coupled with and fixedly mounted by said means for mounting and having spaced passages therethrough and a second pair of pins extendable through said second plate passages, said first and second plates and said first and second pairs of pins extending along the direction of travel of opposite ends of said first engaging means and one pin of each of said pair engaging a respective opposite end of said first engaging means to limit movement thereof at said first position and the other pin of each said pair engaging a respective opposite end of said first engaging means to limit movement thereof at said second position, whereby said first engaging means is constrained for movement between said first and second positions.

* * * * *